US008684503B2

(12) United States Patent
Barker et al.

(10) Patent No.: US 8,684,503 B2
(45) Date of Patent: Apr. 1, 2014

(54) INKJET PRINTERS

(75) Inventors: Jonathan Andrew Barker, Cambridgeshire (GB); Olivier Morel, Essex (GB)

(73) Assignee: Xennia Technology Limited, Hartfordshire (GB)

( * ) Notice: Subject to any disclaimer, the term of this patent is extended or adjusted under 35 U.S.C. 154(b) by 0 days.

(21) Appl. No.: 13/502,159

(22) PCT Filed: Nov. 1, 2010

(86) PCT No.: PCT/GB2010/051823

§ 371 (c)(1),
(2), (4) Date: Apr. 16, 2012

(87) PCT Pub. No.: WO2011/055138

PCT Pub. Date: May 12, 2011

(65) Prior Publication Data

US 2012/0200642 A1 Aug. 9, 2012

(30) Foreign Application Priority Data

Nov. 5, 2009 (GB) ..... 0919404.4

(51) Int. Cl.
*B41J 2/045* (2006.01)

(52) U.S. Cl.
USPC ..... 347/71

(58) Field of Classification Search
USPC ..... 204/478, 509, 511
See application file for complete search history.

(56) References Cited

U.S. PATENT DOCUMENTS

| | | | | |
|---|---|---|---|---|
| 5,475,407 | A | 12/1995 | Ohashi | |
| 5,858,190 | A * | 1/1999 | Hayes | 204/478 |
| 5,939,206 | A | 8/1999 | Kneezel et al. | |
| 6,053,601 | A | 4/2000 | Watanabe et al. | |
| 2001/0055050 | A1 | 12/2001 | Shimosato et al. | |
| 2003/0035031 | A1 * | 2/2003 | Ito et al. | 347/71 |
| 2003/0052949 | A1 | 3/2003 | Watanabe | |
| 2003/0076382 | A1 | 4/2003 | Suzuki | |

FOREIGN PATENT DOCUMENTS

WO 02/089543 A1 11/2002

OTHER PUBLICATIONS

Wikipedia Article: Cross-link, Section: Formation of cross-links, paragraph 1.*
Wikipedia Article: Parylene, Introduction, paragraph 4 and Section: Reactive Parylenes, paragraph 2.*
International Search Report for corresponding International Application No. PCT/GB2010/051823 mailed Feb. 11, 2011.
GB Search Report for corresponding Great Britain Patent Application No. 0919404.4 completed Feb. 18, 2010.

* cited by examiner

*Primary Examiner* — Lisa M Solomon
(74) *Attorney, Agent, or Firm* — Morgan, Lewis & Bockius LLP

(57) ABSTRACT

An inkjet printhead having at least one internal electrode in contact with ink in use, wherein region(s) of the electrode surface are covered by an electrically insulating organic material that has been deposited thereon by electrophoresis.

28 Claims, 1 Drawing Sheet

INKJET PRINTERS

Figure 1:
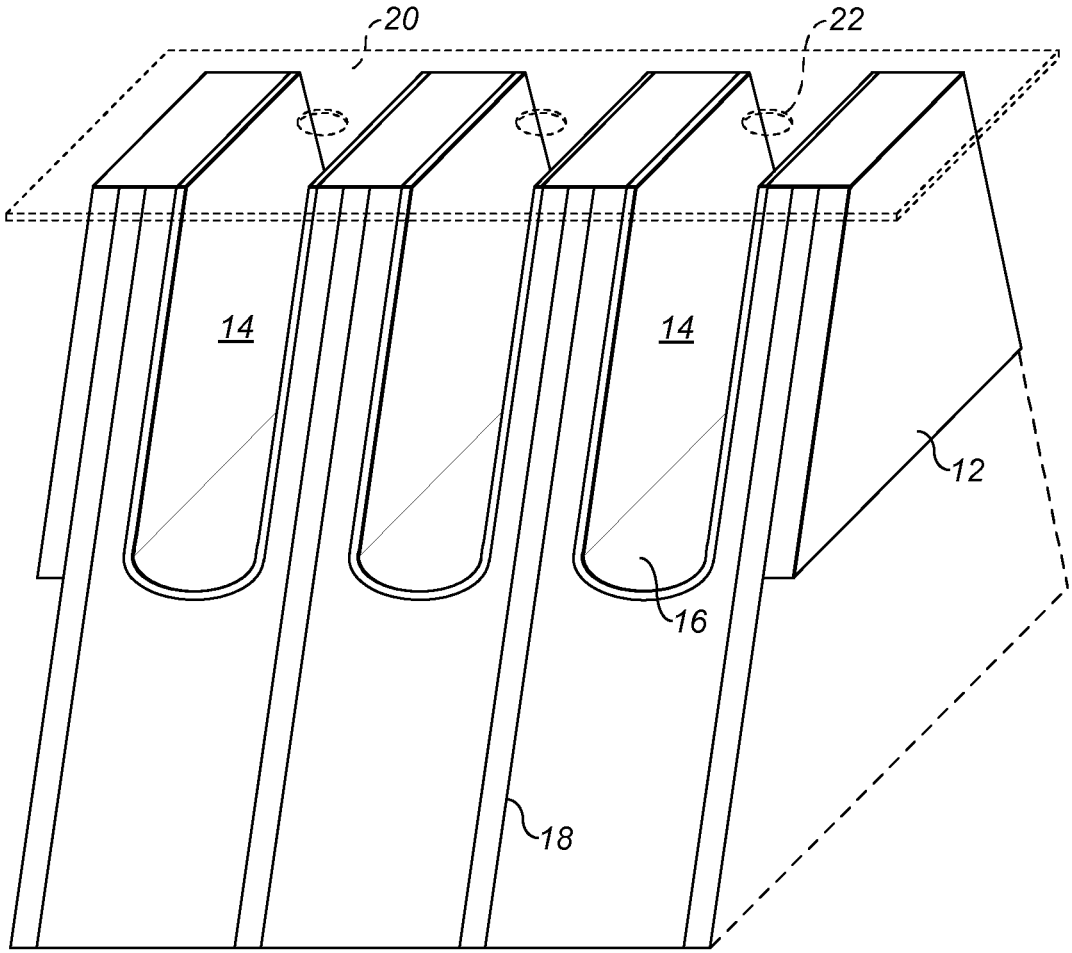

The present application is a U.S. National Phase Application of International Application No. PCT/GB2010/051823, filed Nov. 1, 2010, which claims the benefit of priority of Great Britain Application No. 0919404.4 filed Nov. 5, 2009, the disclosures of which are incorporated herein by reference in their entireties.

FIELD OF THE INVENTION

This invention relates to inkjet printers, and particularly concerns printheads for inkjet printers.

BACKGROUND TO THE INVENTION

In many inkjet printheads, internal electrodes that are used to activate the printhead and create ink droplet ejection come into contact with the ink in the printhead in use. Problems can arise when using electrically conductive inks (aqueous and non-aqueous), and printhead failures are often observed with conductive inks, particularly in piezoelectric printheads. This places constraints on the inks that can be used in the printheads.

The present inventors have investigated this problem in an attempt to determine the cause of printhead failures.

The inventors have observed that the application of a voltage to a conductive ink can cause destabilisation of the ink and electrolysis, which in turn can generate gas bubbles and/or particulate materials which can block inkjet printhead nozzles, leading to printhead failure. This effect is particularly marked in printheads where the ink provides an electrically conductive pathway between oppositely charged electrodes in a piezoelectric printhead.

Further, the inventors have observed that where current can leak from printhead electrodes, higher voltage and more energy is required to achieve the same ejection force from the piezoelectric material. In extreme cases, high ink conductivity can lead to short circuits with consequential damage to electronic components of the printhead, leading to printhead failure.

The present inventors have realised the importance of electrically insulating the printhead electrodes from the ink, and have investigated approaches to achieving effective electrical insulation.

SUMMARY OF THE INVENTION

In one aspect, the present invention provides an inkjet printhead having at least one internal electrode in contact with ink in use, wherein region(s) of the electrode surface are covered by an electrically insulating organic material that has been deposited thereon by electrophoresis.

Electrophoretic deposition or plating is a technique that involves migration of charged particles, suspended or dissolved in a carrier liquid, under the effect of an applied is electric field for deposition on an exposed electrically conductive surface. The method produces uniform, defect-free coatings that can be recognised and identified e.g. by microscopic examination or profilometry.

The organic material thus forms a coating on exposed electrically conductive regions of the electrode.

Because of the nature of the electrophoretic deposition process, material will only be deposited on exposed electrically conductive regions of the electrode and so is selectively deposited on only those areas of the electrode that require protection from the inkjet ink in use. The approach of the invention is thus very efficient.

In a further aspect, the invention provides a method of treating an inkjet printhead internal electrode, comprising depositing on region(s) of the electrode surface an electrically insulating organic material by electrophoretic deposition.

In practice, a printhead has many electrodes, and each electrode of the printhead has electrophoretically-deposited electrically insulating material thereon.

In use of the printhead, the organic material coating functions to insulate the electrode electrically from the ink and so acts to prevent effects discussed above arising with electrically conductive inks, thus reducing the likelihood of printhead failure and so prolonging printhead life, particularly when using conductive inks.

The invention is applicable to any inkjet printhead in which electrodes are exposed to contact with ink in the printhead in normal use, but is of particular benefit with piezoelectric printheads, particularly shared wall piezoelectric printheads, where printhead failure is more prevalent. Use of the invention means that printheads can be used with a wider range of inks than was hitherto possible, particularly electrically conductive inks (aqueous and non-aqueous), e.g. those widely used in textile printing.

The thickness of the coating is not critical provided it is sufficiently thick to provide effective electrical insulation. The coating thickness is typically in the range 1 to 15 is micron, preferably 3 to 10 micron, e.g. about 5 micron.

The organic material typically comprises one or more organic resins, e.g. one or more organic polymers such as acrylate, methacrylate, polyester or urethane polymers. The organic material is preferably cross-linked.

Treatment fluids for production of suitable coatings by electrophoretic deposition typically comprise one or more polymers, pre-polymers, oligomers and/or monomers, e.g. of acrylic or methacrylic materials, typically in suspension or solution in a liquid vehicle. The materials may polymerise after deposition. The materials are preferably cross-linkable, e.g. cross-linking by free radical curing on exposure to appropriate curing conditions such as heat or ultra violet (UV) radiation after deposition. Suitable treatment fluids (heat or UV curable) are commercially available and include, e.g. UVICLAD 602 (UVICLAD is a Trade Mark) which is a UV curable cathodically deposited electropaint emulsion system available from LVH Coatings Limited, Birmingham, UK; ULTEC 3005 (ULTEC is a Trade Mark) which is a thermally curable electrophoretic emulsion available from LVH Coatings Limited; CLEARCLAD HSR (CLEARCLAD is a Trade Mark) which is a thermally curable electrophoretic polyurethane emulsion available from Clearclad Coatings; Electrolac (Electrolac is a Trade Mark) available from MacDermid Corporation; Clearlyte (Clearlyte is a Trade Mark) available from Enthone OMI Inc; Abrilac (Abrilac is a Trade Mark) available from Atotech; and CB105 (CB105 is a Trade Mark), Betaclear 3000 (Betaclear is a Trade Mark) and Alphaclad (Alphaclad is a Trade Mark) which are available from Hawking Technology.

The treatment fluid may include optional additives to impart specific desired properties to the resulting coating, e.g. to improve edge-coating properties or to reduce current leakage. For example, fluorocarbon materials e.g. fluoro-modified resins and surfactants may be used to increase the hydrophobic nature of the material and render the resulting coating more hydrophobic to migrating moisture and ions and so less prone to current leakage. Rheology modifiers, such as nano-alumina or nano-silica, may be used to improve the coating achieved on sharp edges. Fillers, e.g. in the form of particulate materials, preferably in the form of high aspect ratio flakes, such as mica, e.g. mica slurry, nano-clays, nano-alumina dispersions or metallic flakes may be used to reduce the permeability of the coating by imparting a more tortuous route, so making the coating less prone to current leakage.

Suitable electrophoretic deposition techniques (cathodic and anodic) are known to those skilled in the art. For example, WO 02/089543 discloses a method of protecting an exposed conductive connection between a thermal inkjet printhead device and a flexible tape circuit by electrophoretic plating with a polymer. However, this document is not concerned with internal electrodes of printheads, and the polymer performs a different function to the coating of the present invention.

In general, electrophoretic deposition involves contacting the region(s) of the electrode surface to be coated with suitable treatment fluid and establishing a potential difference (in the appropriate sense) between the region(s) and an external electrode in contact with the treatment fluid. This results in electrophoretic deposition of a coating of charged material from the treatment fluid onto the electrode region(s). The thickness of the coating can be readily regulated by appropriate selection of parameters including potential difference, treatment temperature and treatment time to produce a coating of desired thickness, e.g. 1 to 15 micron.

The electrophoretic deposition step is typically preceded by an initial cleaning step, and is typically followed by a washing step, as is known in the art.

The potential difference applied during the electrophoretic deposition is preferably ramped upwardly during the deposition process, as this can improve the quality/integrity of the resulting coating. The potential difference is typically ramped linearly, e.g. from 0 to +40V in 1 minute or from 0 to +30V in 30 seconds After deposition, the coating is conveniently subjected to a curing step by exposure to suitable curing conditions, e.g. heat or electromagnetic radiation of appropriate wavelength such as UV, as is known in the art.

Electrophoretic deposition may be carried out at any desired stage, before, during or after printhead production, and also including on components of the print head prior to assembly.

Electrophoretic deposition may be carried out on the electrode in situ in an assembled or partly assembled printhead. For example, treatment fluid may be put directly into the printhead to be treated, where it will contact electrically conductive region(s) of the electrode. Application of an appropriate voltage to the electrode will result in electrophoretic deposition on the conductive surface regions thereof. As the coating is deposited, electrical resistance increases so reducing deposition. The process is thus self-regulating, dealing with any imperfections in the electrode surface, and produces thicker deposits on areas of greater conductivity, resulting in uniform, defect-free layers. Coating thickness can be readily controlled, as noted above, so it is easy to produce thin coatings that do not risk blocking printhead nozzles. The technique is thus well suited to use in situ on an assembled printhead. Curing can also be carried out on an assembled printhead, e.g. by placing the printhead in an oven at suitable temperature for thermal curing, or by exposing the interior of the printhead to UV light, e.g. passed through a translucent or transparent faceplate of the printhead. When dealing with piezoelectric printheads, it is important not to exceed the curing temperature of the underlying piezoelectric material (typically about 140° C. or 120° C.) as this leads to de-poling and loss of the piezoelectric effect. With piezoelectric printhead electrodes, curing is therefore preferably carried out at temperatures not exceeding about 140° C., more preferably not exceeding 120° C., typically for times of up to about 1.5 hours.

An inkjet printhead electrode is typically formed from a conductive metal such as copper or nickel, or a combination of such metals. The electrically insulating material may be electrophoretically deposited directly on the metal surface of such an electrode.

It is known in the art to apply a corrosion-resistant protective coating to the surface of a metal electrode, such as a coating of Parylene (Parylene is a Trade Mark) polymer material applied by a vapour deposition process. While Parylene is an electrically insulating material, as disclosed in our co-pending International Patent Application No. PCT/GB2010/051039 (the contents of which are incorporated herein by reference) Parylene coatings often have imperfections such as pin holes or other defects. To remedy problems caused by these defects, International Patent Application No. PCT/GB2010/051039 discloses deposition of inert metal such as gold on metal regions of the electrode surface left exposed by imperfections in the Parylene coating. In accordance with the present invention, the electrically insulating material may be electrophoretically deposited on an electrode having a coating of Parylene or similar corrosion-resistant material (with or without inert metal deposited as disclosed in International Patent Application No. PCT/GB2010/051039), with the electrically insulating material being electrophoretically deposited either on regions of the electrode exposed though imperfections in the Parylene coating, or on inert metal deposited on such exposed regions.

The electrophoretically deposited coating of the invention will cover and protect all conductive metal regions of the electrode surface that would otherwise be exposed to ink in use of the printhead, and so additionally acts as a corrosion-resistant protective coating, with additional benefits for printheads when used with electrically conductive inks, as discussed in International Patent Application No. PCT/GB2010/051039. The coating of the invention may thus be used as an alternative to Parylene and similar coatings. The coating of the invention may additionally or alternatively be used as a primer layer with Parylene or similar materials then applied on top.

Thus, the electrophoretically deposited coating of the invention may be used in conjunction with a protective coating of corrosion-resistant material, typically a polymer material such as a xylene-based material, particularly a substituted or unsubstituted polyparaxylxyene material such as those known as Parylene, e.g. Parylene N, Parylene C and Parylene D, or other non-metallic protective coating.

As noted above, various different configurations are possible. Typically, the coating of the invention is deposited electrophoretically on the electrode surface with the protective coating, e.g. of Parylene, applied thereto (with the coating of the invention either in uncured or cured condition). The coating of the invention acts to improve the adhesion of the Parylene or other protective coating to the underlying electrode, as well as providing an additional barrier layer. This is particularly useful where the electrode is of a material such as gold that Parylene etc. does not adhere to well.

Additionally or alternatively, the electrophoretically deposited coating of the invention may be applied on top of a protective coating, e.g. of Parylene, as a remedial treatment to fill any gaps, holes, imperfections etc. in the Parylene or similar layer.

More than one electrophoretically-deposited coating may be provided on the electrode surface. The coatings may be of the same material or different materials. The coatings may be on top of each other, or separated by layers of other materials. Multiple coatings can result in improved quality/integrity of the final coating.

The invention also includes within its scope an inkjet printer including a printhead in accordance with the invention.

The invention will be further described, by way of illustration, in the following examples and with reference to the accompanying drawing, in which:

FIG. 1 is a schematic drawing representing part of a shared wall piezoelectric printhead.

DETAILED DESCRIPTION OF THE DRAWINGS

FIG. 1 shows schematically part of a shared wall piezoelectric printhead 10.

The printhead is formed from a piece of piezoelectric material 12 that has a series of side-by-side channels 14 cut therein, constituting passages through which ink flows in use. The spacing between opposed side walls of each channel is about 70 micron. The entire surface within the channels and down the side of the channels is coated with metal, as indicated at 16, and forms electrodes. Metal is removed from regions 18 between adjacent channels so that the electrodes are isolated from one another. A faceplate 20 extends across the top of the channels, with a series of apertures 22 constituting a respective nozzle for each channel. In use, the wall is activated by having a voltage applied across it, i.e. the electrode on one side is at a higher potential than that on the other side, resulting in deformation of the piezoelectric material 12 to expel a drop of ink from the nozzle.

EXAMPLE 1

Initial experiments were carried out to deposit electrophoretic coatings on test plaques comprising a piece of ceramic approximately 0.5 mm thick×25 mm×86 mm coated with copper with a nickel coating. The experiments used commercially available thermally-curable and UV-curable electrophoretic treatment fluids, namely UVICLAD 602 which is a UV-curable, cathodically deposited electrophoretic emulsion, ULTEC 3005 which is a thermally-curable electrophoretic polyester emulsion, and CLEARCLAD HSR which is a thermally-curable electrophoretic polyurethane emulsion. The treatment fluids were used to deposit electrophoretic coatings on the charged electrode plaques. Voltage and dwell times were selected to produce even, metered coatings, which were then cured to cause cross-linking by appropriate treatment.

The application procedure used for each of the treatment fluids was as follows.

- The surfaces to be coated should first be thoroughly cleaned. This is an essential step, as any contaminant at the surface is a potential area of electrical resist, which will reduce the integrity of the polymer coating.
- Cleaning is achieved by ultrasonication in acetone then electrolytically, using a proprietary alkaline cleaner, ref CLEAN01 from LVH Coatings Limited. A solution is made with DI water at a concentration of 35 g/liter.
- Each surface to be cleaned is immersed in the solution and connected to a DC power supply; electrode connections being made with crocodile clips. The surface to be cleaned is subjected to 10 seconds at +6V DC, with the metal surface acting as the cathode. This is then followed by 10 seconds as the anode.
- This alternating procedure is repeated twice, ending on the anode cycle.
- The metal surface is then subjected to further electrolytic action as a final stage, in a 2% w/v sulphuric acid solution (as the cathode).
- The metal surface is thoroughly rinsed with DI water, and is then ready for electrophoretic coating.
- The metal surface is connected as the cathode to a DC power supply as previously, and immersed in the electrophoretic emulsion, contained within a stainless steel beaker, of diameter 70 mm, which is itself connected as the counter electrode (anode). The cathode (surface to be coated) should be withdrawn from the liquid and returned several times to improve wetting of the surface.
- A potential difference is applied across the electrodes by way of a linear ramp, starting at 0V, reaching a peak of +40V after 1 minute.
- After this time the voltage is removed and the coated electrode removed from the emulsion.
- The coated electrode is rinsed thoroughly with DI water, leaving a matt coating of polymer at the surface.
- Curing Curing was carried out generally in accordance with the suppliers instructions.

- Thermal cure technology (for ULTEC 3005 and CLEARCLAD HSR)
  - Any residual water is blown from the surface, and the metal plaque placed in an oven between 105° C. and 160° C., for 20 mins-8 hours, depending on the temperature. Lower temperatures require longer dwell time. For ULTEC 3005 a typical treatment is 120° C. for 1.5 hours. CLEARCLAD HSR has a higher curing temperature requirement than ULTEC 3005, and a typical treatment is 160° C. for 20 minutes.
- UV curing technology (for UVICLAD 602)
  - Any residual water is blown from the surface, and the plaque dried in an oven at 70° C. for 30 mins, prior to exposure to a UV emitting light source.
- Assuming sufficient polymer deposition, the metal surfaces will now be coated with a uniform, glossy, electrically insulating layer.

The resulting electrophoretically-deposited cross-linked coatings were about 5 micron thick, as measured by confocal microscopy.

EXAMPLE 2

Coating of a more complex array of electrodes, arranged side by side, approximately 70 μm apart, requires a modified method, to ensure adequate coating of all sides of the channel. A suitable procedure is as follows:

Initial cleaning should proceed as Example 1, however after cleaning in acetone, the electrode array is subjected to a further ultrasonication step in deionised water to displace the air from the channels.

After cleaning, the electrode array is immersed in the coating solution, in such a way that the electrodes are positioned vertically, and ultrasonicated to displace the air in the channels and encourage filling with the coating solution.

- A potential difference is applied across the electrodes by way of a linear ramp, starting at 0V, reaching a peak of +30V after 30 seconds.
- After this time the voltage is removed and the coated electrode array removed from the coating solution.
- The coated electrode array is rinsed thoroughly with DI water using a water misting device, leaving a matt coating of polymer at the surface.

Curing then takes place as Example 1, with the coated piece lying flat in the oven.

The same processing can be used for electrophoretic deposition of electrically insulating coatings on an assembled or partly assembled piezoelectric printhead, e.g. as illustrated in FIG. 1, by placing the treatment fluids directly into the printhead. The curing temperature should not exceed 140° C. for the reason given above and preferably should not exceed 120° C. Treatment conditions, particularly voltage and time, are regulated to produce an electrically insulating cross-linked polymer coating about 5 micron thick. This protects the printhead from effects described above when using conductive inks, e.g. water based inks, and means that the printhead is less prone to failure and has a longer working life than has hitherto been possible when using conductive inks.

Further modification of the electrophoretic coating can lead to further reduced current leakage. These modifications include the addition of further materials, such as: mica slurry, nano-alumina dispersion, fluoro-modified resins and surfactants, which can impart a more tortuous route, or simply render the cured film more hydrophobic to migrating moisture and ions.

The uniformity of the electrophoretic coating can be tested in several ways:

1. Current leakage assessment (Method 1).
2. Chemical detection of exposed electrode using dimethylglyoxime (DMG) reagent (Method 2).

Method 1

A coated plaque or nickel foil sample is immersed in a conductive fluid of known conductivity, to a depth of 15 mm, and electrically connected to the power supply as the anode. A counter nickel electrode is also immersed in the fluid to a similar depth, and connected as the cathode. These electrodes are placed approximately 50 mm apart. A picoammeter such as a 6487/E from Keithley Instruments, can be used to record the measured leakage current between these two electrodes, whilst increasing voltages are applied. A low current leakage of the order <4 nA is achieved at an applied voltage of +10V, over a period of 2 minutes. Extending this period to 72 hours (held at +10V) gave an average current leakage of ~200 nA.

Method 2

Dimethylglyoxime (DMG) is a common reagent for the detection of nickel ions. This chelating agent forms a strong red complex with free nickel ions, in solution environments above pH7. The procedure for Method 1 should be followed, with the conductive fluid being replaced by an aqueous DMG solution. Applying a voltage across the electrodes will generate nickel ions in any areas of exposed electrode due to electrolysis. Any red discolouration then detected in the DMG solution is an indication of incomplete coverage of the coating. When used with a UV/Vis spectrophotometer this method allows for quantitative assessment of the exposed surface area, by measurement of the absorption of the chromophore; after application of a controlled voltage for a defined dwell time.

Current Leakage Testing Results

The current leakage assessment procedure of Method 1 was used to assess three samples, namely two nickel foil test pieces in accordance with the invention coated electrophoretically with ULTEC 3005 and CLEARCLAD HSR by the method of Example 1, and a commercially available Parylene-coated nickel test plaque (for comparison). The ULTEC 3005 was cured at 120° C. for 1.5 hours and the CLEARCLAD HSR was cured at 160° C. for 20 minutes, with the electrophoretically-deposited cross-linked coatings having a thickness of about 5 microns. The Parylene-coated test plaques were stated to have a coating thickness of about 5 microns.

The test procedure is to increase the applied voltage by 0.25V every 2 mins (from 0-5V) and then by 1V every 2 mins (from 5-10V). The leakage currents recorded after 30 mins, having reached 10V, are tabulated below.

| Sample | Leakage current (Amps) |
|---|---|
| Nickel test plaque Parylene coated | $230 \times 10^{-6}$ |
| 20 μm Nickel foil EP coated with Ultec 3005 | $4 \times 10^{-9}$ |
| 20 μm Nickel foil EP coated with Clearclad HSR | $10 \times 10^{-12}$ |

The current leakage test results show that the samples with the electrophoretically deposited coating in accordance with the invention had significantly lower current leakage than that coated with Parylene, indicating that the electrophoretically deposited coatings have greater integrity and insulating properties than the Parlyene coating.

The invention claimed is:

1. An inkjet printhead having at least one internal electrode in contact with ink in use, wherein region(s) of the electrode surface are covered by an electrically insulating polyester or polyurethane material that has been deposited thereon by electrophoresis.

2. An inkjet printhead according to claim 1, wherein the printhead is a piezoelectric printhead.

3. An inkjet printhead according to claim 1, wherein the polyester or polyurethane material comprises a cross-linked polymer.

4. An inkjet printhead according to claim 1, wherein the polyester or polyurethane material has a thickness in the range of 1 to 15 microns.

5. An inkjet printer, comprising a printhead according to claim 1.

6. A method of treating an inkjet printhead internal electrode, comprising depositing on region(s) of the electrode surface an electrically insulating polyester or polyurethane material by electrophoretic deposition.

7. A method according to claim 6, wherein electrophoretic deposited material is cured to cause cross-linking.

8. A method according to claim 7, wherein the curing is caused by exposure to heat or ultra violet radiation.

9. A method according to claim 7, wherein the curing is carried out at a temperature not exceeding about 140° C.

10. A method according to claim 6, wherein the printhead is a piezoelectric printhead.

11. A method according to claim 6, wherein the electrophoretic deposition is carried out at a ramped potential difference.

12. A method according to claim 6, wherein electrophoretic deposition is carried out on a fully or partly assembled printhead.

13. A method according to claim 6, wherein the deposited organic material has a thickness in the range of 1 to 15 microns.

14. An inkjet printhead according to claim 1, having more than one electrophoretically deposited coating on the electrode surface.

15. An inkjet printhead according to claim 1, wherein the insulating material includes a rheology modifier.

16. An inkjet printhead according to claim 1, further comprising a corrosion-resistant protective coating on the electrode.

17. An inkjet printhead according to claim 2, wherein the piezoelectric printhead is a shared wall piezoelectric printhead.

18. An inkjet printhead according to claim 4, wherein the polyester or polyurethane material has a thickness in the range of 3 to 10 microns.

19. A method according to claim 9, wherein the curing is carried out at a temperature not exceeding about 120° C.

20. An inkjet printhead according to claim 10, wherein the piezoelectric printhead is a shared wall piezoelectric printhead.

21. A method according to claim 13, wherein the deposited organic material has a thickness in the range of 3 to 10 microns.

22. An inkjet printhead according to claim 15, wherein the rheology modifier is nano-alumina or nano-silica.

23. An inkjet printhead according to claim 16, wherein the corrosion-resistant protective coating on the electrode is a substituted or unsubstituted polyparaxylylene material.

24. A method according to claim 6, further comprising electrophoretically depositing a further coating of electrically insulating organic material on the electrode surface.

25. A method according to claim 24, wherein the insulating material includes a rheology modifier.

26. A method according to claim 6, further comprising depositing on the electrode a corrosion-resistant protective coating.

27. A method according to claim 26, wherein the corrosion-resistant protective coating is a substituted or unsubstituted polyparaxylylene material.

28. A method according to claim 10, wherein the piezoelectric printhead is a shared wall piezoelectric printhead.

* * * * *